US005876521A

United States Patent [19]

Koo et al.

[11] Patent Number: 5,876,521

[45] Date of Patent: Mar. 2, 1999

[54] ULTRA HIGH STRENGTH, SECONDARY HARDENING STEELS WITH SUPERIOR TOUGHNESS AND WELDABILITY

[76] Inventors: Jayoung Koo, 10 Gateshead Dr.; Michael John Luton, 1580 Mountain Top Rd., both of Bridgewater, N.J. 08807

[21] Appl. No.: 483,347

[22] Filed: Jun. 7, 1995

Related U.S. Application Data

[62] Division of Ser. No. 349,857, Dec. 6, 1994, Pat. No. 5,545,269.

[51] Int. Cl.[6] ..... C22C 38/22; C22C 38/24; C22C 38/26; C22C 38/47

[52] U.S. Cl. ..... 148/328; 148/335; 148/336; 420/109; 420/110; 420/111

[58] Field of Search ..... 148/328, 336, 148/335; 420/109, 124, 119, 110, 111

[56] References Cited

U.S. PATENT DOCUMENTS

| | | | |
|---|---|---|---|
| 4,767,475 | 8/1988 | Fukuda et al. | 148/336 |
| 5,310,431 | 5/1994 | Buck | 148/328 |
| 5,449,420 | 9/1995 | Okada et al. | 148/335 |
| 5,454,883 | 10/1995 | Yoshie et al. | 148/336 |

*Primary Examiner*—Deborah Yee
*Attorney, Agent, or Firm*—Jay Simon

[57] ABSTRACT

High strength steel is produced by a first rolling of a steel composition, reheated above 1100° C., above the austenite recrystallization, a second rolling below the austenite recrystallization temperature, water cooling from above $Ar_3$ to less than 400° C. and followed by tempering below the $Ac_1$ transformation point.

7 Claims, 6 Drawing Sheets

ULTRA HIGH STRENGTH, SECONDARY HARDENING STEELS WITH SUPERIOR TOUGHNESS AND WELDABILITY

This is a division of application Ser. No. 349,857, filed Dec. 6, 1994, now U.S. Pat. No. 5,545,269.

FILED OF THE INVENTION

This invention relates to ultra high strength steel plate linepipe having superior weldability, heat affected zone (HAZ) strength, and low temperature toughness. More particularly, this invention relates to high strength, low alloy linepipe steels with secondary hardening where the strength of the HAZ is substantially the same as that in the remainder of the linepipe, and to a process for manufacturing plate which is a precursor for the linepipe.

BACKGROUND OF THE INVENTION

Currently, the highest yield strength linepipe commercially available is about 80 ksi. While higher strength steel has been experimentally produced, e.g., up to about 100 ksi several problems remain to be addressed before the steel can be safely used as linepipe. One such problem is the use of boron as a component of the steel. While boron can enhance material strength, steels containing boron are difficult to process leading to inconsistent products as well as an increased susceptibility to stress corrosion cracking.

Another problem relating to high strength steels, i.e., steels having a yield strength greater than about 80 ksi, is the softening of the HAZ after welding. The HAZ undergoes local phase transformation or annealing during the welding induced thermal cycles, leading to a significant, up to about 15% or more, softening of the HAZ as compared to the base metal.

Consequently, it is an object of this invention to produce low alloy, ultra high strength steel for linepipe use with a thickness of at least 10 mm, preferably 15 mm, more preferably 20 mm, having a yield strength at least about 120 ksi and a tensile strength of at least about 130 ksi while maintaining consistent product quality, substantially eliminating or at least reducing the loss of strength in the HAZ during the welding induced thermal cycle, and having sufficient toughness at ambient and low temperatures.

A further object of this invention is to provide a producer friendly steel with unique secondary hardening response to accommodate a wide variety of tempering parameters, e.g., time and temperature.

SUMMARY OF THE INVENTION

In accordance with this invention, a balance between steel chemistry and processing technique is achieved thereby allowing the manufacture of high strength steel having a specified minimum yield strength (SMYS) of ≧100 ksi, preferably ≧110 ksi, more preferably ≧120 ksi, from which linepipe may be prepared, and which after welding, maintains the strength of the HAZ at substantially the same level as the remainder of the linepipe. Further, this ultra high strength, low alloy steel does not contain boron, i.e., less than 5 ppm, preferably less than 1 ppm and most preferably no added boron, and the linepipe product quality remains consistent and not overly susceptible to stress corrosion cracking.

The preferred steel product has a substantially uniform microstructure comprised primarily of fine grained, tempered martensite and bainite which may be secondarily hardened by precipitates of ϵ-copper and the carbides or nitrides or carbonitrides of vanadium, niobium and molybdenum. These precipitates, especially vanadium, minimize HAZ softening, likely by preventing the elimination of dislocations in regions heated to temperatures no higher than the $A_{c1}$ transformation point or by inducing precipitation hardening in regions heated to temperatures above the $A_{c1}$ transformation point or both.

The steel plate of this invention is manufactured by preparing a steel billet in the usual fashion and having the following chemistry, in weight percent:

0.03–0.12% C, preferably 0.05–0.09% C 0.10–0.50% Si 0.40–2.0% Mn 0.50–2.0% Cu, preferably 0.6 - 1.5% Cu 0.50–2.0% Ni 0.03–0.12% Nb, preferably 0.04–0.08% Nb 0.03–0.15% V, preferably 0.04–0.08% V 0.20–0.80% Mo, preferably 0.3–0.6% Mo 0.30–1.0% Cr, preferably for hydrogen containing environments 0.005–0.03 Ti 0.01–0.05 Al Pcm ≦0.35 the sum of vanadium +niobium ≧0.1%, the balance being Fe and incidental impurities.

Additionally, the well known contaminants N, P, and S are minimized, even though some N is desired, as explained below, for providing grain growth inhibiting titanium nitride particles. Preferably, N concentration is about 0.001–0.01%, S no more than 0.01%, and P no more than 0.01%. In this chemistry the steel is boron free in that there is no added boron, and the boron concentration ≦5 ppm, preferably less than 1 ppm.

Figure 1:
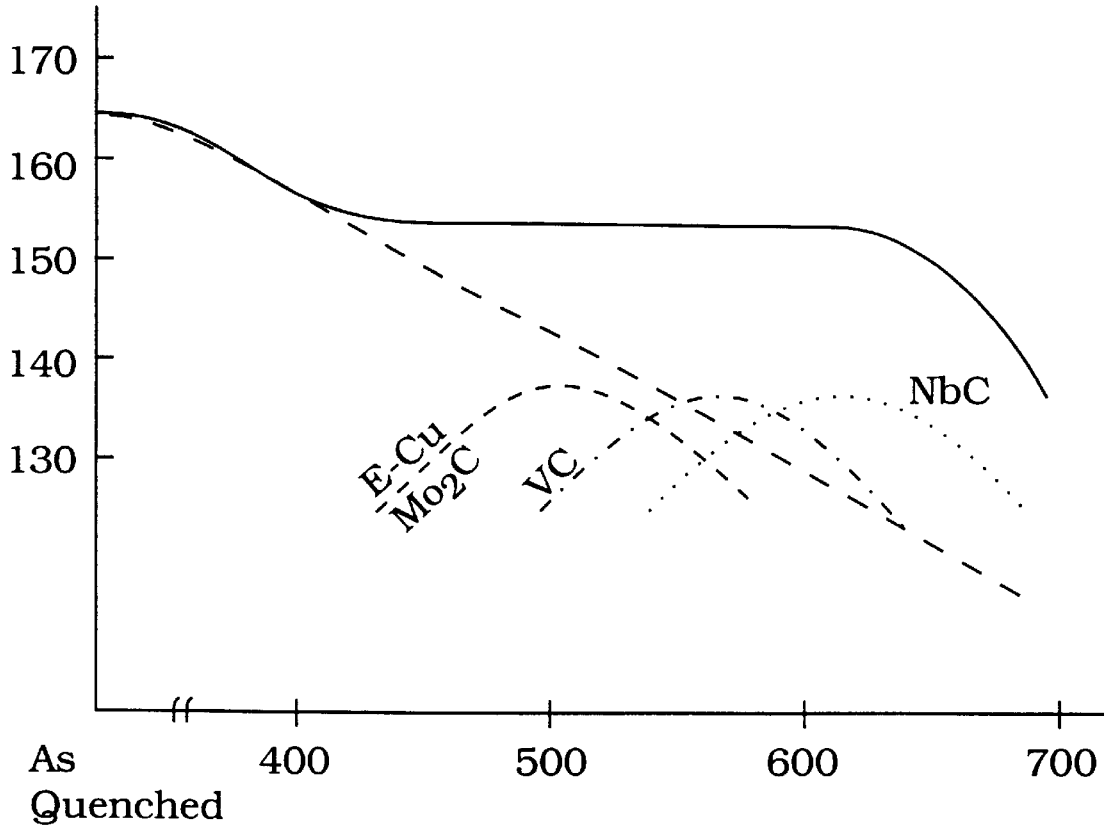
FIG. 1 is a plot of tensile strength (ksi) of the steel plate (ordinate) vs. tempering temperature (abscissa) in °C. The figure also reveals, schematically, the additive effect of hardening/strengthening associated with the precipitation of ϵ-copper and the carbides and carbonitrides of molybdenum, vanadium and niobium.

(squares) and A2 (triangles) for 3 kilo joules/mm heat input. Typical microhardness data for a lower strength commercial linepipe steel, X100, is also plotted for comparison (dotted line).

The steel billet is processed by: heating the billet to a temperature sufficient to dissolve substantially all, and preferably all vanadium carbonitrides and niobium carbonitrides, preferably in the range of 1100°–1250° C.; a first hot rolling of the billet to a rolling reduction of 30–70% to form plate in one or more passes at a first temperature regime in which austenite recrystallizes; a second hot rolling to a reduction of 40–70% in one or more passes at a second temperature regime somewhat lower than the first temperature and at which austenite does not recrystallize and above the $Ar_3$ transformation point; hardening the rolled plate by water quenching at a rate of at least 20° C./second, preferably at least about 30° C./second, from a temperature no lower than the Ar3 transformation point to a temperature no higher than 400° C.; and tempering the hardened, rolled plate at a temperature no higher than the $A_{c1}$ transition point for a time sufficient to precipitate at least one or more ϵ-copper, and the carbides or nitrides or carbonitrides of vanadium, niobium and molybdenum.

DETAILED DESCRIPTION OF THE INVENTION

Ultra high strength steels necessarily require a variety of properties and these properties are produced by a combination of elements and thermomechanical treatments, e.g., small changes in chemistry of the steel can lead to large changes in the product characteristics. The role of the various alloying elements and the preferred limits on their concentrations for the present invention are given below:

Carbon provides matrix strengthening in all steels and welds, whatever the microstructure, and also precipitation strengthening primarily through the formation of small Nb(C,N), V(C,N), and $Mo_2C$ particles or precipitates, if they are sufficiently fine and numerous. In addition, Nb(C,N) precipitation during hot rolling serves to retard recrystallization and to inhibit grain growth, thereby providing a means of austenite grain refinement and leading to an improvement in both strength and low temperature toughness. Carbon also assists hardenability, i.e., the ability to form harder and stronger microstructures on cooling the steel. If the carbon content is less than 0.03%, these strengthening effects will not be obtained. If the carbon content is greater than 0.12%, the steel will be susceptible to cold cracking on field welding and the toughness is lowered in the steel plate and its weld HAZ.

Manganese is a matrix strengthener in steels and welds and it also contributes strongly to the hardenability. A minimum amount of 0.4% Mn is needed to achieve the necessary high strength. Like carbon, it is harmful to toughness of plates and welds when too high, and it also causes cold cracking on field welding, so an upper limit of 2.0% Mn is imposed. This limit is also needed to prevent severe center line segregation in continuously cast linepipe steels, which is a factor helping to cause hydrogen induced cracking (HIC).

Silicon is always added to steel for deoxidization purposes and at least 0.1% is needed in this role. It is also a strong ferrite solid solution strengthness. In greater amounts Si has an adverse effect on HAZ toughness, which is reduced to unacceptable levels when more than 0.5% is present.

Niobium is added to promote grain refinement of the rolled microstructure of the steel, which improves both the strength and the toughness. Niobium carbonitride precipitation during hot rolling serves to retard recrystallization and to inhibit grain growth, thereby providing a means of austenite grain refinement. It will give additional strengthening on tempering through the formation of Nb(C,N) precipitates. However, too much niobium will be harmful to the weldability and HAZ toughness, so a maximum of 0.12% is imposed.

Titanium, when added as a small amount is effective in forming fine particles of TiN which can contribute to grain size refinement in the rolled structure and also act as an inhibitor for grain coarsening in the HAZ of the steel. Thus, the toughness is improved. Titanium is added in such an amount that the ratio Ti/N is 3.4 so that free nitrogen combines with the Ti to form TiN particles. A Ti/N ration of 3.4 also insures that finely dispersed TiN particles are formed during continuous casting of the steel billet. These fine particles serve to inhibit grain growth during the subsequent reheating and hot rolling of austenite. Excess titanium will deteriorate the toughness of the steel and welds by forming coarser Ti (C,N) particles. A titanium content below 0.005% cannot provide a sufficiently fine grain size, while more than 0.03% causes a deterioration in toughness.

Copper is added to provide precipitation strengthening on tempering the steel after rolling by forming fine copper particles in the steel matrix. Copper is also beneficial for corrosion resistance and HIC resistance. Too much copper will cause excessive precipitation hardening and poor toughness. Also, more copper makes the steel more prone to surface cracking during hot rolling, so a maximum of 2.0% is specified.

Nickel is added to counteract the harmful effect of copper on surface cracking during hot rolling. It is also beneficial to the toughness of the steel and its HAZ. Nickel is generally a beneficial element, except for the tendency to promote sulfide stress cracking when more than 2% is added. For this reason the maximum amount is limited to 2.0%.

Aluminum is added to these steels for the purpose of deoxidization. At least 0.01% Al is required for this purpose. Aluminum also plays an important role in providing HAZ toughness by the elimination of free nitrogen in the coarse grain HAZ region where the heat of welding allows the TiN to partially dissolve, thereby liberating nitrogen. If the aluminum content is too high, i.e., above 0.05%, there is a tendency to form $Al_2O_3$ type inclusions, which are harmful for the toughness of the steel and its HAZ.

Vanadium is added to give precipitation strengthening, by forming fine VC particles in the steel on tempering and its HAZ on cooling after welding. When dissolved in austenite, vanadium has a strong beneficial effect on hardenability. Thus vanadium will be effective in maintaining the HAZ strength in a high strength steel. There is a maximum limit of 0.15% since excessive vanadium will help cause cold cracking on field welding, and also deteriorate the toughness of the steel and its HAZ.

Molybdenum increases the hardenability of a steel on direct quenching, so that a strong matrix microstructure is produced and it also gives precipitation strengthening on tempering by forming $Mo_2C$ and NbMo carbide particles. Excessive molybdenum helps to cause cold cracking on field welding, and also deteriorates the toughness of the steel and it HAZ, so a maximum of 0.8% is specified.

Chromium also increases the hardenability on direct quenching. It improves corrosion and HIC resistance. In particular, it is preferred for preventing hydrogen ingress by forming a $Cr_2O_3$ rich oxide film on the steel surface. A chromium content below 0.3% cannot provide a stable $Cr_2O_3$ film on the steel surface. As for molybdenum, excessive chromium helps to cause cold cracking on field welding, and also deteriorate the toughness of the steel and its HAZ, so a maximum of 1.0% is imposed.

Nitrogen cannot be prevented from entering and remaining in steel during steelmaking. In this steel a small amount is beneficial in forming fine TiN particles which prevent grain growth during hot rolling and thereby promote grain refinement in the rolled steel and its HAZ. At least 0.001% N is required to provide the necessary volume fraction of TiN. However, too much nitrogen deteriorates the toughness of the steel and its HAZ, so a maximum amount of 0.01% N is imposed.

While high strength steels have been produced with yield strengths of 120 ksi or higher, these steels lack the toughness and weldability requirements necessary for linepipe because such materials have a relatively high carbon equivalent, i.e., higher than a Pcm of 0.35 as specified herein.

The first goal of the thermomechanical treatment is achieving a sufficiently fine microstructure of tempered martensite and bainite which is secondarily hardened by even more finely dispersed precipitates of ϵ-Cu, $Mo_2C$,V (C,N) and Nb(C,N). The fine laths of the tempered martensite/bainite provide the material with high strength and good low temperature toughness. Thus, the heated austenite grains are first made fine in size, e.g., ≦20 microns, and second, deformed and flattened so that the through thickness dimension of the austenite grains is yet smaller, e.g., ≦8–10 microns and third, these flattened austenite grains are filled with a high dislocation density and shear bands. This leads to a high density of potential nucleation sites for the formation of the transformation phases when the steel billet is cooled after the completion of hot rolling. The second goal is to retain sufficient Cu, Mo, V, and Nb, substantially in solid solution after the billet is cooled to room temperature so that the Cu, Mo, V, and Nb, are available during the tempering treatment to be precipitated as ϵ-Cu, $Mo_2C$, Nb(C,N), and V(C,N). Thus, the reheating temperature before hot rolling the billet has to satisfy both the demands of maximizing solubility of the Cu, V, Nb, and Mo while preventing the dissolution of the TiN particles formed during the continuous casting of the steel and thereby preventing coarsening of the austenite grains prior to hot-rolling. To achieve both these goals for the steel compositions of the present invention, the reheating temperature before hot-rolling should not be less than 1100° C. and not greater than 125° C. The reheating temperature that is used for any steel composition within the range of the present invention is readily determined either by experiment or by calculation using suitable models.

The temperature that defines the boundary between these two ranges of temperature, the recrystallization range and the non-recrystallization range, depends on the heating temperature before rolling, the carbon concentration, the niobium concentration and the amount of reduction given in the rolling passes. This temperature can be determined for each steel composition either by experiment or by model calculation.

These hot-rolling conditions provide, in addition to making the austenitic grains fine in size, an increase in the dislocation density through the formation of deformation bands in the austenitic grains thereby maximizing the density of potential sites within the deformed austenite for the nucleation of the transformation products during the cooling after the rolling is finished. If the rolling reduction in the recrystallization temperature range is decreased while the rolling reduction in the non-recrystallization temperature range is increased the austenite grains will be insufficiently fine in size resulting in coarse austenite grains thereby reducing both strength and toughness and causing higher stress corrosion cracking susceptibility. On the other hand, if the rolling reduction in the recrystallization temperature range is increased while the rolling reduction in the non-recrystallization temperature range is decreased, formation of deformation bands and dislocation substructures in the austenite grains becomes inadequate for providing sufficient refinement of the transformation products when the steel is cooled after the rolling is finished.

After finish rolling, the steel is subjected to water-quenching from a temperature no lower than the $A_{r3}$ transformation temperature and terminating at a temperature no higher than 400° C. Air cooling cannot be used because it will cause the austenite to transform to ferrite/pearlite aggregates leading to deterioration in strength. In addition, during air-cooling, Cu will be precipitated and over-aged, rendering it virtually ineffective for precipitation strengthening on tempering.

Termination of the water cooling at temperature above 400° C. causes insufficient transformation hardening during the cooling, thereby reducing the strength of the steel plate.

The hot-rolled and water-cooled steel plate is then subjected to a tempering treatment which is conducted at a temperature that is no higher than the $A_{c1}$ transformation point. This tempering treatment is conducted for the purposes of improving the toughness of the steel and allowing sufficient precipitation substantially uniformly throughout the microstructure of ϵ-Cu, $Mo_2C$, Nb(C,N), and V(C,N) for increasing strength. Accordingly, the secondary strengthening is produced by the combined effect of ϵ-Cu, $Mo_2C$, V(C,N) and Nb(C,N), precipitates. The peak hardening due to ϵ-Cu and $Mo_2C$ occurs in the temperature range 450° C. to 550° C., while hardening due to V(C,N)/Nb(C,N) occurs in the temperature range 550° C. to 650° C. The employment of these species of precipitates to achieve the secondary hardening provides a hardening response that is minimally affected by variation in matrix composition or microstructure thereby providing uniform hardening throughout the plate. In addition, the wide temperature range of the secondary hardening response means that the steel strengthening is relatively insensitive to the tempering temperature. Accordingly, the steel is required to be tempered for a period of at least 10 minutes, preferably at least 20 minutes, e.g., 30 minutes, at a temperature that is greater than about 400° C. and less than about 700° C., preferably 500°–650° C.

A steel plate produced through the described process exhibits high strength and high toughness with high uniformity in the through thickness direction of the plate, in spite of the relatively low carbon concentration. In addition the tendency for heat affected zone softening is reduced by the presence of, and additional formation of V(C,N) and Nb(C,N) precipitates during welding. Furthermore, the sensitivity of the steel to hydrogen induced cracking is remarkably reduced.

The HAZ develops during the welding induced thermal cycle and may extend for 2–5 mm from the welding fusion line. In this zone a temperature gradient forms, e.g., about 700° C. to about 1400° C., which encompasses an area in which the following softening phenomena occur, from lower to higher temperature: softening by high temperature tempering reaction, and softening by austenitization and slow cooling. In the first such area, the vanadium and niobium and their carbides or nitrides are present to prevent or substantially minimize the softening by retaining the high dislocation density and substructures; in the second such area additional vanadium and niobium carbonitride precipitates form and minimize the softening. The net effect during the welding induced thermal cycle is that the HAZ retains substantially all of the strength of the remaining, base steel in the linepipe. The loss of strength is less than about 10%, preferably less than about 5%, and more preferably the loss of strength is less than about 2% relative to the strength of the base steel. That is, the strength of the HAZ after welding is at least about 90% of the strength of the base metal, preferably at least about 95% of the strength of the base metal, and more preferably at least about 98% of the strength of the base metal. Maintaining strength in the HAZ is primarily due to vanadium +niobium concentration of ≧0.1%, and preferably each of vanadium and niobium are present in the steel in concentrations of ≧0.4%.

Linepipe is formed from plate by the well known U-O-E process in which: plate is formed into a-U-shape, then formed into an-O-shape, and the O shape is Expanded 1 to 3%. The forming and expansion with their concomitant work hardening effects leads to the highest strength for the linepipe.

The following examples serve to illustrate the invention described above.

DESCRIPTION AND EXAMPLES OF EMBODIMENTS

A 500 lb. heat of each alloy representing the following chemistries was vacuum induction melted, cast into ingots and forged into 100 mm thick slabs and further hot rolled as described below for the characterization of properties. Table 1 shows the chemical composition (wt %) for alloys A1 and A2.

TABLE 1

| | Alloy | |
|---|---|---|
| | A1 | A2 |
| C | 0.089 | 0.056 |
| Mn | 1.91 | 1.26 |
| P | 0.006 | 0.006 |
| S | 0.004 | 0.004 |
| Si | 0.13 | 0.11 |
| Mo | 0.42 | 0.40 |
| Cr | 0.31 | 0.29 |
| Cu | 0.83 | 0.63 |
| Ni | 1.05 | 1.04 |
| Nb | 0.068 | 0.064 |
| V | 0.062 | 0.061 |
| Ti | 0.024 | 0.020 |
| Al | 0.018 | 0.019 |
| N (ppm) | 34 | 34 |
| $P_{cm}$ | 0.30 | 0.22 |

The as-cast ingots must undergo proper reheating prior to rolling to induce the desired effects on microstructure. Reheating serves the purpose of substantially dissolving in the austenite the carbides and carbonitrides of Mo, Nb and V so these elements can be reprecipitated later on in steel processing in more desired form, i.e., fine precipitation in austenite before quenching as well as upon tempering and welding of the austenite transformation products. In the present invention, reheating is effected at temperatures to the range 1100° to 1250° C., and more specifically 1240° C. for alloy 1 and 1160° C. for alloy 2, each for 2 hours. The alloy design and the thermomechanical processing have been geared to produce the following balance with regard to the strong carbonitride formers, specifically niobium and vanadium:

- about one third of these elements precipitate in austenite prior to quenching
- about one third of these elements precipitate in austenite transformation products upon tempering following quenching
- about one third of these elements are retained in solid solution to be available for precipitation in the HAZ to ameliorate the normal softening observed in the steels having yield strength greater than 80 ksi.

The thermomechanical rolling schedule involving the 100 mm square initial slab is shown below in Table 2 for alloy A1. The rolling schedule for alloy A2 was similar but the reheat temperature was 1160° C.

TABLE 2

Starting Thickness: 100 mm
Reheat Temperature: 1240° C.

| Pass | Thickness (mm) After Pass | Temperature (°C.) |
|---|---|---|
| 0 | 100 | 1240 |
| 1 | 85 | 1104 |
| 2 | 70 | 1082 |
| 3 | 57 | 1060 |
| | Delay (turn piece on edge)(1) | |
| 4 | 47 | 899 |
| 5 | 38 | 877 |
| 6 | 32 | 852 |
| 7 | 25 | 827 |
| 8 | 20 | 799 |
| | Water Quench to Room Temperature | |

(1)allows cooling on all sides because of small sample.

The steel was quenched from the finish rolling temperature to ambient temperature at a cooling rate of 30° C./second. This cooling rate produced the desired as-quenched microstructure consisting predominantly of bainite and/or martensite, or more preferably, 100% lath martensite.

In general, upon aging, steel softens and loses its as-quenched hardness and strength, the degree of this strength loss being a function of the specific chemistry of the steel. In the steels of the present invention, this natural loss in strength/hardness is substantially eliminated or significantly ameliorated by a combination of fine precipitation of ϵ-copper, VC, NbC, and $Mo_2C$.

Tempering was carried out at various temperatures in the 400° to 700° C. range for 30 minutes, followed by water quenching or air cooling, preferably water quenching to ambient temperature.

The design of the multiple secondary hardening resulting from the precipitates as reflected in the strength of the steel is schematically illustrated in FIG. 1 for Alloy A1. This steel has a high as-quenched hardness and strength, but would soften, in the absence of secondary hardening precipitators, readily in the aging temperature range 400° to 700° C., as shown schematically by the continuously declining dotted line. The solid line represents the actual measured properties of the steel. The tensile strength of the steel is remarkably insensitive to aging in the broad temperature range 400° to 650° C. Strengthening results from the ϵ-Cu, $Mo_2C$, VC, NbC precipitation occurring and peaking at various temperature regimes in this broad aging range and providing cumulative strength to compensate for the loss of strength normally seen with aging of plain carbon and low alloy martensitic steels with no strong carbide formers. In Alloy A2, which has lower carbon and Pcm values, the secondary hardening processes showed similar behavior as Alloy A1, but the strength level was lower than that in Alloy A1 for all processing conditions.

Figure 2:
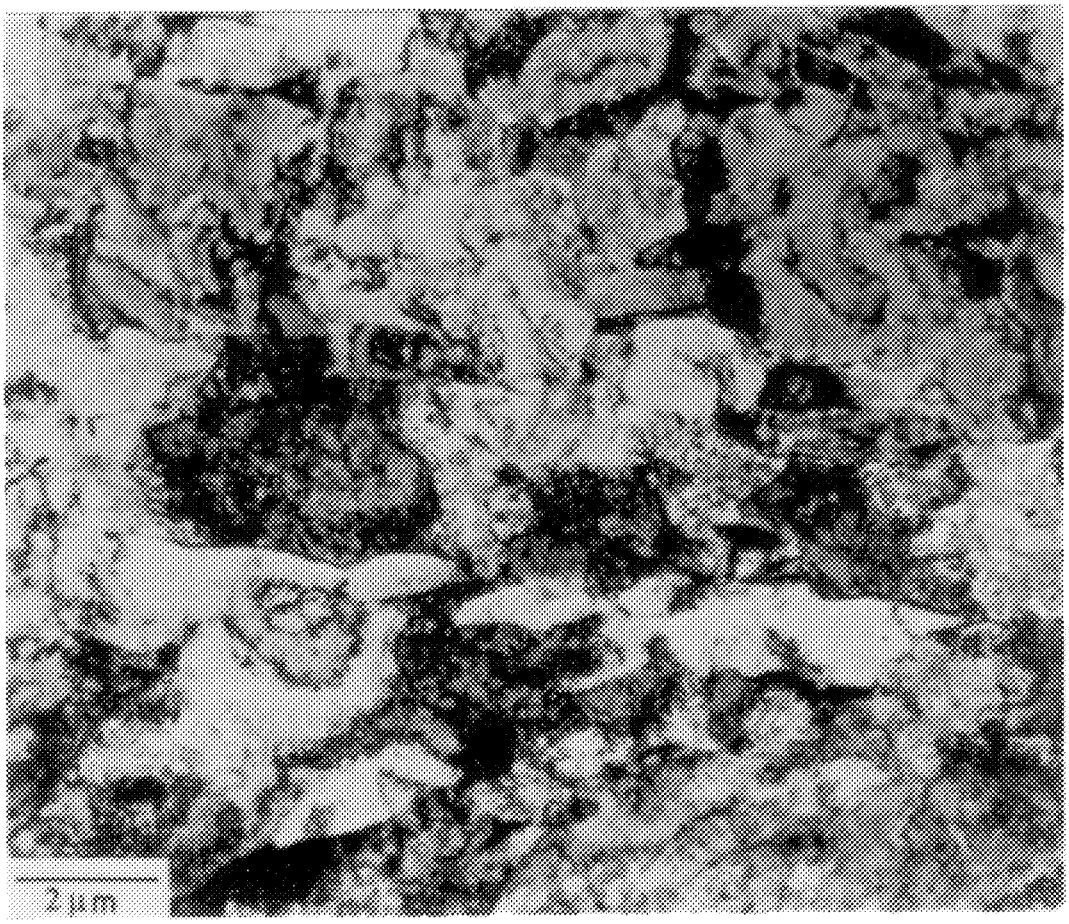
FIG. 2 is a bright field transmission electron micrograph revealing the granular bainite microstructure of the as-quenched plate of Alloy A2.
Figure 3:
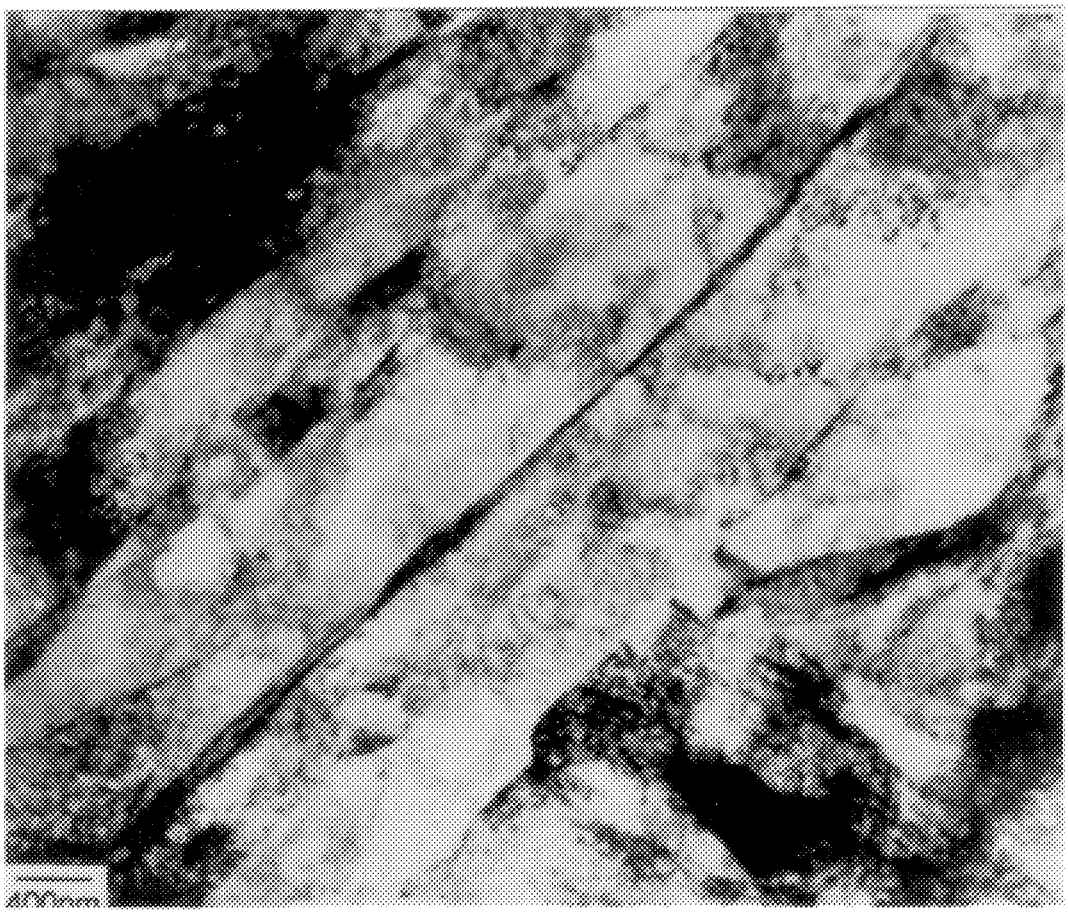
FIG. 3 is a bright field transmission electron micrograph revealing the lath martensitic microstructure of the as-quenched plate of Alloy A1.
Figure 4:
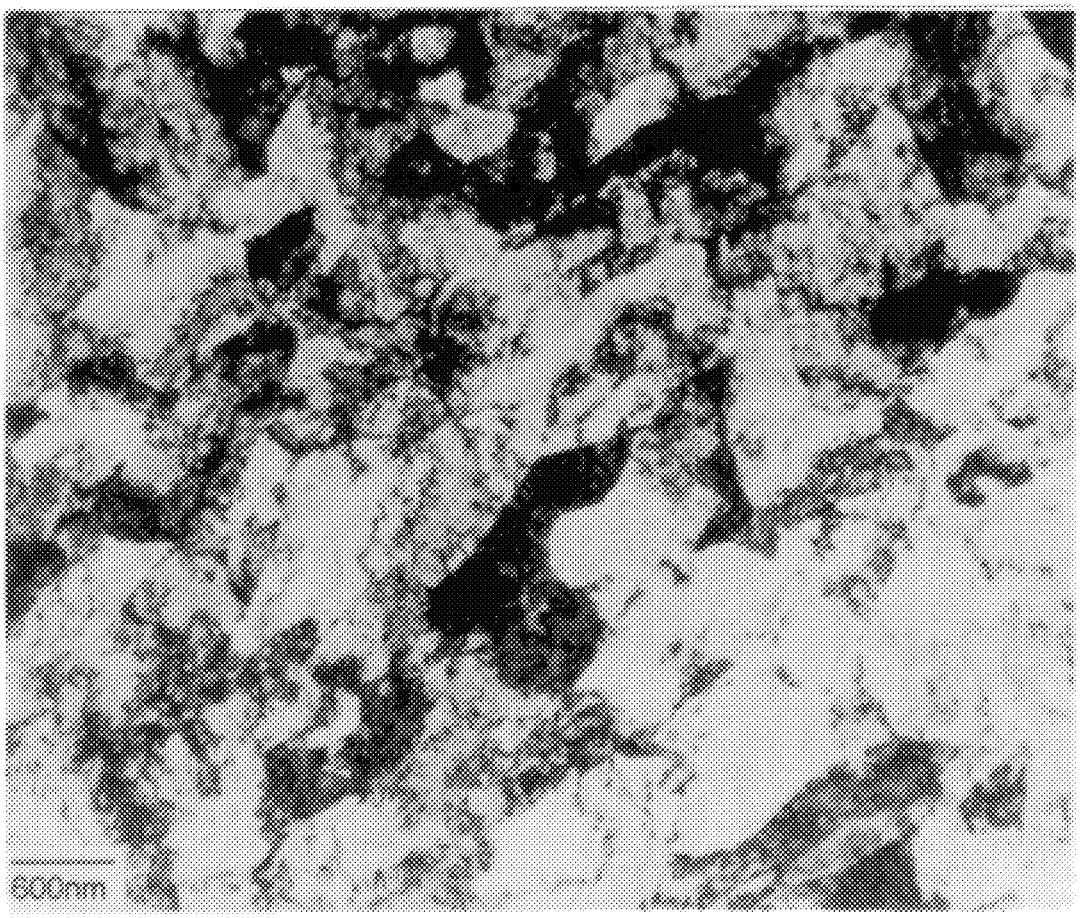
FIG. 4 is a bright-field transmission electron micrograph from Alloy A2 quenched and tempered at 600° C. for 30 minutes. The as-quenched dislocations are substantially retained after tempering indicating the remarkable stability of this microstructure.

An example of as-quenched microstructure is presented in FIGS. 2 and 3 which show the predominantly granular bainitic and martensitic microstructure, respectively, of these alloys. The higher hardenability resulting from the higher alloying in Alloy A1 resulted in the the lath martensitic structure while Alloy A2 was characterized by predominantly granular bainite. Remarkably, even after tempering at 600° C., both the alloys showed excellent microstructural stability, FIG. 4, with insignificant recovery in the dislocation substructure and little cell/lath/grain growth.

Figure 5:
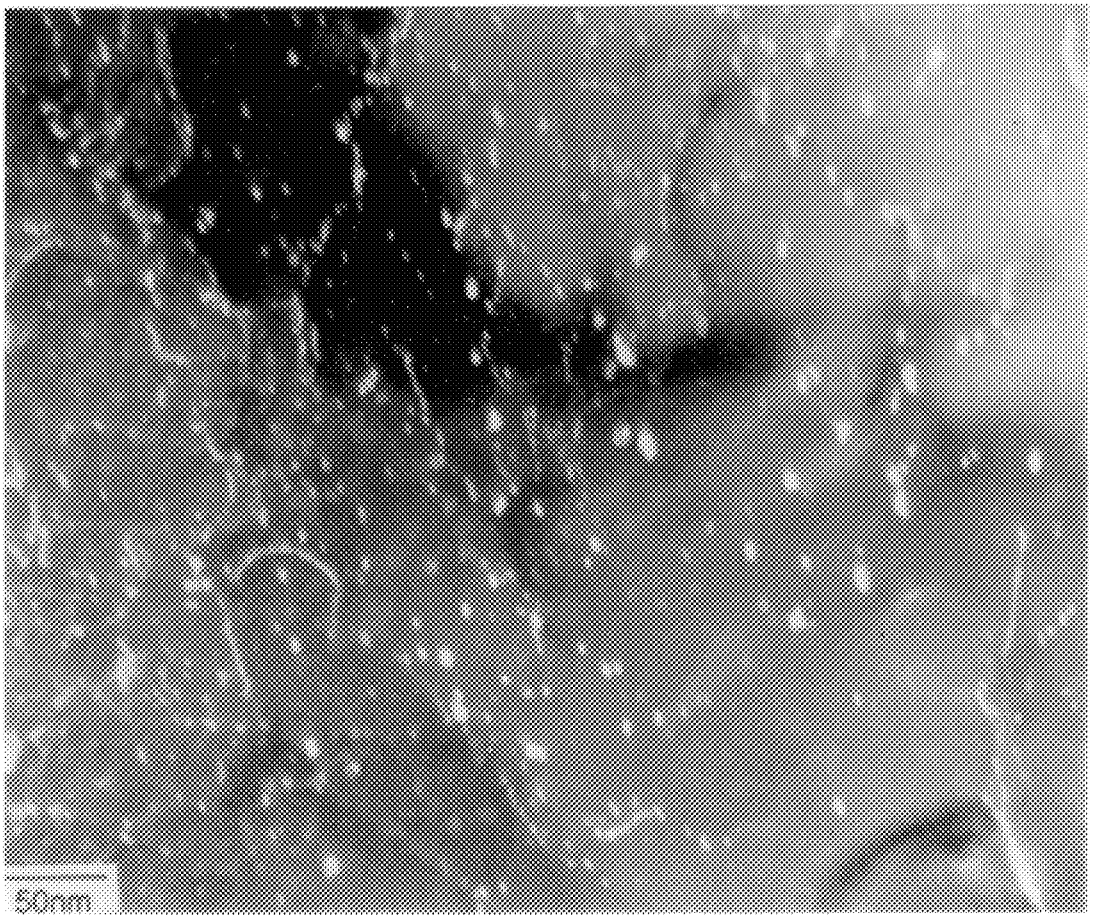
FIG. 5 is a high magnification precipitate dark-field transmission electron micrograph from Alloy A1 quenched and tempered at 600° C. for 30 minutes revealing complex, mixed precipitation. The coarsest globular particles are identified to be ϵ-copper while the finer particles are of the (V,Nb)(C,N) type. The fine needles are of the (Mo,V,Nb)(C,N) type and these needles decorate and pin several of the dislocations.

Upon tempering in the range 500° to 650° C., secondary hardening precipitation was seen first in the form of ϵ-copper precipitates, globular and needle type precipitates of the type $Mo_2C$ and (Nb,V)C. Particle size for the precipitates ranged from 10 to 150 Å. A very high magnification transmission electron micrograph taken selectively to highlight the precipitates is shown in the precipitate dark-field image, FIG. 5.

The ambient tensile data is summarized in Table 3 together with ambient and low temperature toughness. It is clear that Alloy A1 exceeds the minimum desired tensile strength of this invention while that of Alloy A2 meets this criterion.

Charpy-V-Notch impact toughness at ambient and at −40° C., temperature was performed on longitudinal and transverse samples in accordance with ASTM specification E23. For all the tempering conditions Alloy A2 had higher impact toughness, well in excess of 200 joules at −400C. Alloy A1 also demonstrated excellent impact toughness in light of its ultra high strength, exceeding 100 joules at −40° C., preferably the steel toughness ≧120 joules at −40° C.

Figure 6:
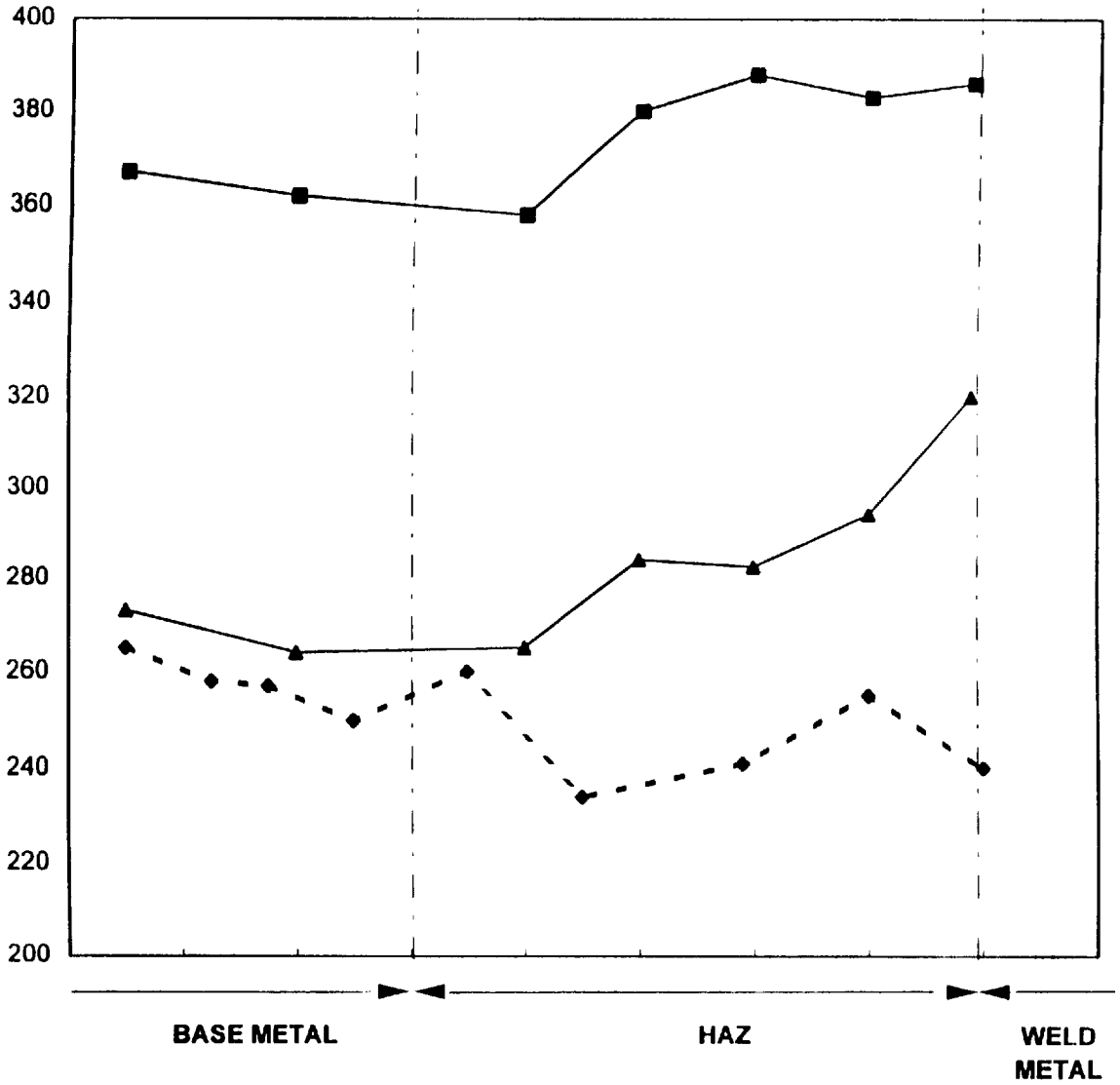
FIG. 6 is a plot of microhardness (Vickers Hardness Number, VHN on the ordinate) across the weld, heat-affected zone (HAZ) for the steels on the abscissa A1

The micro hardeness data obtained from laboratory single bead on plate welding test is plotted in FIG. 6 for the steels of the present invention along with comparable data for a commercial, lower strength linepipe steel, X100. The laboratory welding was performed at a 3kJ/mm heat input and hardness profiles across the weld HAZ are shown. Steels produced in accordance with the present invention display a remarkable resistance to HAZ softening, less than about 2% as compared to the hardness of the base metal. In contrast, the commercial X100 which has a far lower base metal strength and hardness compared to that of Al steel, a significant, about 15%, softening is seen in the HAZ. This is even more remarkable since it is well known that maintenance of base metal strength in the HAZ becomes even more difficult as the base metal strength increases. The high strength HAZ of this invention is obtained when the welding heat input ranges from about 1–5 kilo joules/mm.

TABLE 3

TYPICAL MECHANICAL PROPERTIES

| | | TENSILE PROPERTIES[1] | | | CHARPY IMPACT PROPERTIES[2] | |
|---|---|---|---|---|---|---|
| STEEL | CONDITION | YS MPA (KSI) | UTS MPA (KSI) | EL (%) | $vE_{20}$ Joules (FT-LBS) | $vE_{40}$ Joules (FT-LBS) |
| A1 | As-quenched | 904 (130) | 1205 (173) | 13 | 136 (100) | 108 (80) |
| | 550° C. (1022° F.) tempering for 30 minutes | 1058 (152) | 1090 (156) | 15 | 123 (91) | 100 (74) |
| | 650° C. (1202° F.) tempering for 30 minutes | 1030 (148) | 1038 (149) | 17 | 157 (116) | 118 (87) |
| A2 | As-quenched | 904 (130) | 1205 (173) | 13 | 136 (100) | 108 (80) |
| | 550° C. (1022° F.) tempering for 30 minutes | 1058 (152) | 1090 (156) | 15 | 123 (91) | 100 (74) |
| | 650° C. (1202° F.) tempering for 30 minutes | 1030 (148) | 1038 (149) | 17 | 157 (116) | 118 (87) |

[1]Transverse direction, round samples (ASTM, E8): YS-0.2% offset yield strength; UTS-ultimate tensile strength; EL-elongation in 25.4 mm gauge length

[2]Transverse sample: $vE_{20}$-V-Notch energy at 20° C. testing; $vE_{40}$-V-Notch energy at −40° C. testing

What is claimed is:

1. A high strength, low alloy, weldable steel comprising predominantly martensite/bainite phase containing precipitates of ϵ-copper, and the carbides, nitrides, or carbonitrides of vanadium, niobium, and molybdenum, wherein the concentrations of vanadium+niobium≦0.1 wt %, the carbon content ranges from about 0.03 to 0.12 wt %, and chromium is present in amounts ranging from 0.3–1.0 wt %.

2. The steel of claim 1 in the form of plate of a thickness of at least about 10 mm.

3. The steel of claim 1 wherein additional amounts of vanadium and niobium are in solution.

4. The steel of claim 3 wherein concentrations each of vanadium and niobium are ≧0.04 wt %.

5. The steel of claim 1 wherein the chemistry in wt % is:

0.03–0.12% C
0.01–0.50% Si
0.40–2.0% Mn
0.50–2.0% Cu
0.50–2.0% Ni
0.03–0.12% Nb
0.03–0.15% V
0.20–0.80% Mo
0.005–0.03 Ti
0.01–0.05 Al
$P_{cm}$≦0.35 the balance being Fe.

6. The steel of claim 4 wherein the strength of the HAZ after welding is at least 95% of the strength of the base metal.

7. The steel of claim 4 wherein the strength of the HAZ after welding is at least 98% of the strength of the base metal.

* * * * *